United States Patent [19]

Bresell

[11] 4,190,150

[45] Feb. 26, 1980

[54] SANITARY PROTECTIVE SHEATH WITH DISPOSABLE ABSORBENT LINER FOR TOBACCO PIPE STEM

[76] Inventor: Raymond J. Bresell, 18 Moody Ave., Claremont, N.H. 03743

[21] Appl. No.: 958,914

[22] Filed: Nov. 8, 1978

[51] Int. Cl.[2] ..... A24F 3/00; A24F 9/00; B65D 65/02

[52] U.S. Cl. ..... 206/244; 131/228; 150/52 R

[58] Field of Search ..... 206/244, 236, 242; 131/228; 150/52 R

[56] References Cited

U.S. PATENT DOCUMENTS

| | | | |
|---|---|---|---|
| 825,750 | 7/1906 | Neustadtl | 206/244 |
| 1,277,159 | 8/1918 | Walker | 131/228 |
| 1,617,580 | 2/1927 | Ellis | 131/228 |
| 1,934,115 | 11/1933 | Burns | 150/52 R |
| 2,604,981 | 7/1952 | Weinstock | 206/244 |

FOREIGN PATENT DOCUMENTS

| | | | |
|---|---|---|---|
| 423602 | 5/1967 | Switzerland | 150/52 R |

*Primary Examiner*—William T. Dixson, Jr.
*Attorney, Agent, or Firm*—Sughrue, Rothwell, Mion, Zinn and Macpeak

[57] ABSTRACT

A tubular, open ended elongated liquid impervious sheath bears internally, a removable tubular absorbent material liner. A buckled strap borne by the sheath adjacent its mouth permits the sheath to be frictionally clamped to the pipe stem adjacent the bowl ensuring retention of the stem within the lining which absorbs any liquid. The strap bears a pouch holding a cylindrical plug employed in closing off the sheath absent a pipe, and a replacement liner.

6 Claims, 6 Drawing Figures

FIG. 1
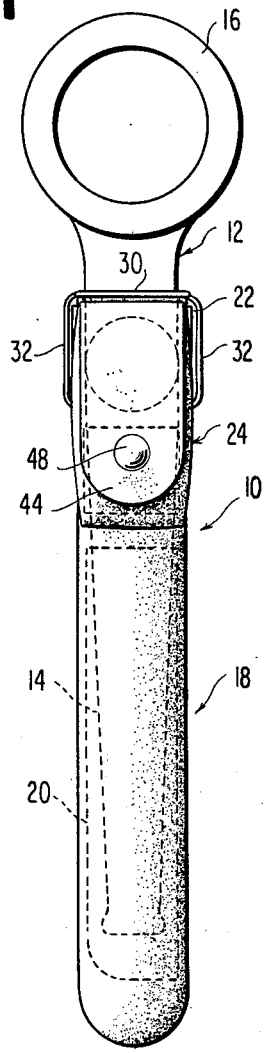
FIG. 2
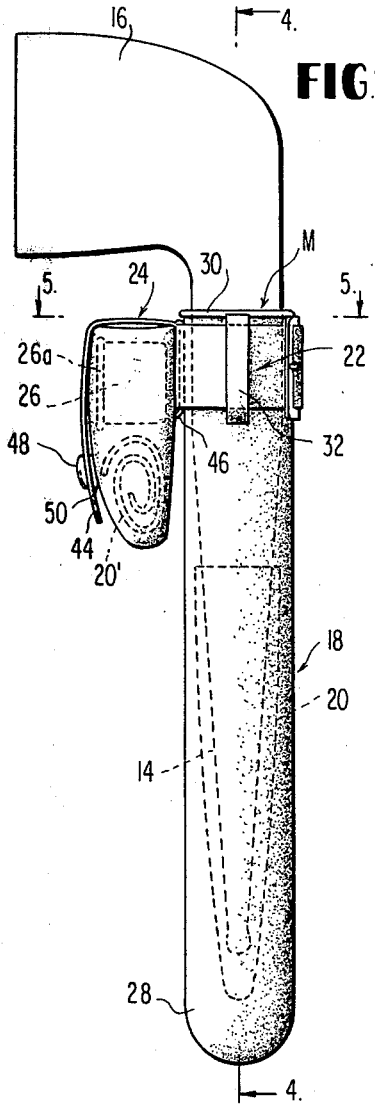
FIG. 3
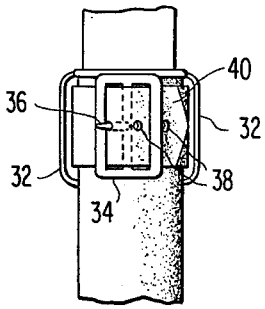
FIG. 4
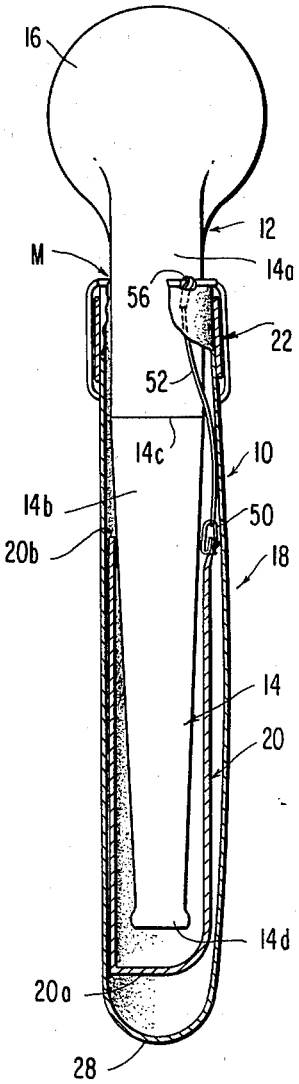
FIG. 5
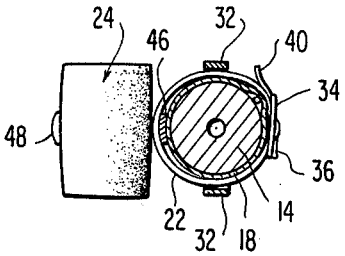
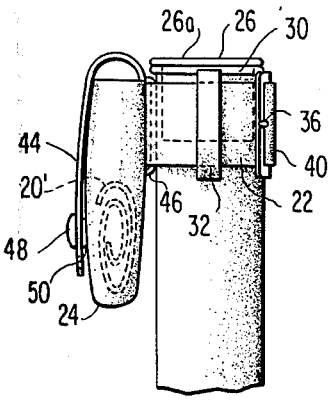
FIG. 6

SANITARY PROTECTIVE SHEATH WITH DISPOSABLE ABSORBENT LINER FOR TOBACCO PIPE STEM

FIELD OF THE INVENTION

This invention relates to protective sheathes for tobacco pipes, cigar and cigarette holders and the like, and more particularly to a protective sheath which is adjustable to closely receive various size pipes and holders and which eliminates staining of the sheath interior itself.

BACKGROUND OF THE INVENTION

Since tobacco pipes, cigar and cigarette holders are held in the mouth during the burning of the tobacco, moisture from the mouth tends to penetrate the interior of the tobacco pipe and cigarette holder, and particularly the stem area in the immediate vicinity of the smoker's mouth. Conventionally, when the smoker terminates the smoking of tobacco, either in a pipe, cigar or cigarette holder form, the pipe or holder is simply inserted in the smoker's shirt or coat pocket. The liquid accumulating within the pipe or holder interior as well as the moisture from the mouth adhering to the external surface of the pipe stem or holder contacts immediately or by gravity movement seeps into the clothing of the smoker providing unsightly stains to the clothes which are additionally difficult to remove.

Attempts have been made to employ pouches, wrappings or similar implements as protective devices for the tobacco pipe, cigar or cigarette holder. Where the protective device envelopes the complete pipe including the bowl, they are of a size essentially determined by the size of the pipe in toto, are relatively bulky and while the protector itself prevents the staining of the clothing, the liquid accumulates within the interior of the protective device, rendering it unsightly and malodorous and making the tobacco smoker repugnant or reluctant to place the pipe or holder after use, back into a previously stained and wet protective device interior. Further, these devices have been manufactured in terms of given holder or tobacco pipe size and are not universally adapted for receiving various size pipes or cigar and cigarette holders.

It is, therefore, a primary object of the present invention to provide an improved tobacco pipe, cigar or cigarette holder sanitary protector which constitutes a complete unit, protects itself from external foreign matter and which insures a clean and dirt free receptacle for various size tobacco pipes, cigar and cigarette holders.

It is a further object of this invention to provide an improved sanitary protector particularly applicable to tobacco pipes and to accommodate most pipe stems in terms of conventional size and shape from straight to full bend.

It is a further object of the present invention to provide a pipe, cigar and cigarette holder sanitary protector of this type having an internal, removable and disposable absorbent material liner for easy replacement when soiled or at the smoker's discretion.

SUMMARY OF THE INVENTION

The invention is directed to a sanitary protective sheath assembly for a smoker's pipe, cigar, cigarette holder or the like, such protective sheath assembly comprising an elongated tubular sheath being closed at one end and open at the other to form a mouth for receiving the stem portion of the smoker's pipe or the like. A tubular absorbent liner sized to fit within the sheath and also being closed at one end is insertably received within the sheath interior retrievably coupled to a line coupled to the liner at one end and to the mouth of the sheath at the other, permitting the liner to be withdrawn after use. An adjustably sized closure band or strap surrounds the sheath adjacent the mouth for adjustably closing off the mouth about the upper end of a pipe stem adjacent the pipe holder to secure the sheath to the pipe. A closed cover pouch may be borne by the strap with a cylindrical plug carried internally of the pouch along with a replacement liner. The pouch is sized and is carried adjacent the bowl to one side of the sheath rendering it unobtrusive. Preferably, the strap bears a belt buckle and the strap carries holes to permit the strap to be buckled so as to close off the mouth of the sheath and to frictionally grip the pipe stem adjacent the pipe bowl, regardless of stem diameter variation.

BRIEF DESCRIPTION OF THE DRAWINGS

FIG. 1 is a top plan view of the sanitary protective sheath assembly of the present invention forming one embodiment of the present invention and a smoker's pipe having its stem inserted within the same.

FIG. 2 is a side elevational view of the protective sheath assembly and the pipe of FIG. 1.

FIG. 3 is a bottom plan view of a portion of the assembly and pipe of FIGS. 1 and 2 showing the buckling of the strap carried by the sheath.

FIG. 4 is a longitudinal sectional view of the assembly and pipe of FIG. 2 taken about line 4—4.

FIG. 5 is a transverse sectional view of the assembly and pipe of FIG. 2 taken about line 5—5.

FIG. 6 is a side elevational view of a portion of the protective sheath assembly of the present invention with the pipe removed and the plug inserted within the mouth of the protective sheath.

DESCRIPTION OF THE PREFERRED EMBODIMENT

Referring to the drawings, there is shown in the figures a tobacco pipe, cigar and cigarette holder sanitary protector assembly indicated generally at 10, as applied to a tobacco pipe, indicated generally at 12, of conventional construction and configuration. The pipe 12 is comprised of two basic parts, a stem indicated generally at 14 and a bowl 16; the stem 14 in this case being arbitrarily designated as the portion of the pipe 12 acting as an extension to the bowl 16 and being generally at right angles to the axis of that bowl. Thus, the stem 14 includes insofar as this description is concerned, or an inner stem section **14*a* and an outer stem section 14*b* which may in fact be mechanically joined for separation as by way of separation line 14*c*. The outer section 14*b* remote from the bowl 16 terminates in a flat tip 14*b*. It is from the tip 14*d* that the majority of liquid seepage occurs, when the pipe is stored in vertically upright position, as shown in FIGS. 1, 2 and 4, within the sanitary protective sheath assembly 10**, normally with the pipe (or alternatively a cigarette or cigar holder) being inserted within the breast pocket of the shirt or coat of the smoker.

Turning to the sanitary protective sheath assembly 10, it in turn is comprised of major elements including an elongated tubular sheath or cover indicated generally at 18, a tubular absorbent liner 20 insertably carried within the sheath 18, an adjustably sized strap or band indicated generally at 22 supported adjacent the open end of sheath end and an auxiliary pouch 24 carried by the strap 22 and thus supported on the exterior of the sheath 18.

The sheath or cover 18 preferably comprises a molded product consisting of a round, open at one end and closed at the other, cylindrical tube, and provided with diametrically opposed loops 32 adjacent the open end as defined by lip or bead 30, lip 30 defining a mouth M for reception of the pipe stem 14. The sheath 18 is preferably formed of a non-porous material such as rubber, being provided with the flexibility needed to accommodate the inserted tobacco pipe, cigar or cigarette holder and permitting the wall of the sheath to be compressed radially to frictionally fit the sheath to the stem 14 of the pipe. The annular wall of the sheath 18 is of ample thickness to give support to and assist the strap 22 to provide a firm liquid seal about the circumference of the pipe stem 14 during use. The lower end 28 of the sheath 18 is rounded and closed, while its opposite end is open as provided by lip or bead 30. The bead or lip 30 additionally serves the purpose to firmly hold a connector 56, FIG. 4, associated with the removable absorbent liner 20. The molded tubular resilient sheath 18 may have integrally molded, diametrically opposed loops 32 adjacent the mouth M which extends parallel to the axis of the sheath, the loops 32 receiving the narrow elasticized fabric band or strap 22 which strap or band in turn supports the pouch 24 of the assembly. The elasticized fabric band 22 constitutes a flexible fastening and contains spaced eyelets or holes 38 adjacent one end 40 of the strap, the opposite end bearing a buckle 34 which buckle is provided with a pivotable finger 36 which projects through a given eyelet or hole 38, thus reducing the diameter of the circular loop defined by the band 22 and causing the sheath to be compressed radially about stem 14 of the pipe.

A cylindrical device is thus frictionally held within the sheath 18, that device may be a smoker's appliance such as the tobacco pipe 12 shown, alternatively a cigar or cigarette holder as indicated previously as well as a cylindrical protective plug 26 which includes an enlarged diameter portion **26*a* at one end of a size corresponding to rim 30 and seating on the rim 30, when inserted, FIG. 6, and buckled into frictional contact by the utilization of the strap or band 22. The width of the band or strap 22 is generally equal to the axial length of the plug 26**.

The pouch 24 is manufactured of the same material as the sheath 18 or alternatively may be a different material which could be leather, plastic, cloth, canvas, and in size sufficient to accommodate not only the plug 24 but also a spare absorbent liner as at 20', FIG. 2, and additional elements may be carried therein such as a pipe smoker's wire, etc. The pouch 24 is also of tubular construction and includes integrally a flap 44 constituting a cover for the open end of the pipe and the pouch proper being provided with snap connectors or fitting members 48 and 50 respectively to snap the cover and maintain it in closed position except when access is required for either the plug 26 or the spare liner 20'. Preferably, a loop as at 46 is carried by the pouch 24, the loop being sized similar to loops 32 and receiving the strap or band 22, thus maintaining the pouch on the strap or band and the band or strap on the sheath at all times. The buckle simply adjusts the frictional force and gripping capability of the sheath with respect to the inserted pipe stem 14. The material for the loop 46 may be leather or plastic or the like.

The protector plug 26 may be formed of leather, rubber or plastic and is solid. The enlarged diameter portion or rim **26*a* permits it to be inserted to the extent of lip 30 of sleeve 18 and tightening of the belt of the band or strap 22 effects the closure of the sheath absent the pipe 12, FIG. 6, as shown. In order to prevent loss of the plug 26, the plug itself may be coupled to the pouch by a suitable tether which could be formed of waxed twine, plastic or fisherman's line of a length sufficient to permit the plug to be fully inserted within the interior of the pouch 24, one end of the tether to the pouch cover 44 and the other to the plug on the end carrying rim 26*a***.

The absorbent liner indicated generally at 20 is soft, pliable and absorbent, may constitute a paper material and is thus able to conform to the shape of the device such as the pipe stem 14 inserted therein. Preferably, the absorbent liner material is chemically treated so as to be both safe to the user and to improve or at least not diminish absorbing capability. The liner is in tubular form, being closed at its lower end **20*a* and open at its upper end 20*b*. Further, the length of the liner is somewhat shorter than that of the sheath 18, partially because the liquid is in the vicinity of the tip 14*d* of the pipe stem 14. In this respect, upon insertion of the liner 20, it is required that it be easily removed from the sheath 18. In that respect, a small C-shaped metal clip 50 attaches to the open end 20*b* of the liner 20 and one end of a pull line 52 is connected thereto while the opposite end bears the connector 56 which is of U-shaped configuration and simply snaps to the bead or rim 30 of sheath 18. The length of the line 52 is essentially the difference between the axial length of the liner and that of the sheath. The connector 56 is preferably formed of spring steel and shaped to fit over the lip 30 of the sheath. It acts as a retreiver along with line 52 for the liner 20 and also constitues a preventive measure against the liner 20 accidentally dropping out of the sheath or cover 18. This prevents not only the liner from being lost but also from being soiled. The pull or retrieving line 52 may comprise waxed twine, a strip of leather cloth or a plastic cord. The clip 54 is provided with a prong which projects through the absorbent liner 20 and mechanically locks the pull line at its lower end to the upper end 20*b* of the liner 20**.

The sanitary protective sheath assembly for a smoker's pipe or the like from the description may be seen to function quite capably in absorbing moisture and sedimentation emitted through the mouthpiece, thereby keeping the external areas of the mouthpiece dry while the sheath restricts the moisture from the mouthpiece to the interior wall of the sheath, thus forming a very safe carrier for the smoker's appliance and eliminating all possibility of soiling clothing or other wearing apparel such as jackets, trousers, shirt pockets or other clothing or articles within which the pipe may be carried and make contact such as in drawings and suitcases. Additionally, the sheath maintains the inserted mouthpiece of the smoker's appliance completely free and safe from the possibility of contact with any external liquid or from entering the interior thereof as well as other external foreign matter such as dust particles and the like. Further, by use of the plug 26 the cigar and cigarette holder may be carried by the sheath with the plug in place keeping the holder protected from external liquids, dirt, dust and other matter. This is also possible with respect to a pipe stem.

While the invention has been particularly shown and described with reference to a preferred embodiment thereof, it will be understood by those skilled in the art that various changes in form and details may be made therein without departing from the spirit and scope of the invention.

What is claimed is:

1. A sanitary protective sheath assembly for sheathing a smoking pipe stem, cigarette or cigar holder mouthpiece or the like, said sheath assembly comprising:

an elongated tubular sheath, said sheath being closed at one end and open at the other to form a mouth for reception of the pipe stem, a tubular absorbent material being transversely sized to fit within said sheath, being closed at one end and open at the other end and insertably carried within the closed end of said sheath, means carried by said liner and projecting upwardly from said liner to the mouth of said sheath for effecting retrieval of said liner, an adjustable closure strap surrounding said sheath adjacent said mouth for adjustably closing off said sheath at said mouth about the upper end of said pipe stem to frictional lock the sheath to a given variable diameter pipe stem, cigarette holder mouthpiece, etc, a pouch carried by said strap exterior of said sheath, said pouch including a lockable cover permitting access to the pouch interior, and said assembly including a cylindrical plug having a diameter less than the diameter of said sheath at the open end thereof;

whereby replacement of the pipe stem with the plug permits the strap to close off the upper end of said sheath about said plug and to prevent contamination of the sheath interior or the disposable lining when the sheath is not employed in sheathing the pipe stem or the like.

2. The sheath assembly as claimed in claim 1, wherein said sheath includes a plurality of loops adjacent the open end, said strap encircles said sheath and is fitted to said loops and said strap carries a buckle at one end and bears eyelets on the other end, with said strap buckled at said eyelets to frictionally grip either said pipe stem or said plug to close off said sheath interior.

3. The sheath assembly as claimed in claim 2, wherein said pouch comprises a loop corresponding in size to the loops carried by said sheath and said strap projects through the loop of said pouch to maintain the pouch attached to the strap and adjacent the outside of said sheath at the mouth thereof.

4. The sheath assembly as claimed in claim 2, wherein said sheath terminates at said mouth in a rounded lip, said absorbent material liner has an axial length which is less than that of said sheath and said means for retrieving said liner from said sheath comprises a retrieving line connected to the open end of said liner by a clip at one end thereof and connected to said sheath lip by a connector at the opposite end thereof.

5. The sheath assembly as claimed in claim 3, wherein said sheath terminates at said mouth in a rounded lip, said absorbent material liner has an axial length which is less than that of said sheath and said means for retrieving said liner from said sheath comprises a retrieving line connected to the open end of said liner by a clip at one end thereof and connected to said sheath lip by a connector at the opposite end thereof.

6. A sanitary protective sheath assembly for sheathing a smoking pipe stem, cigarette or cigar holder mouthpiece or the like, said sheath assembly comprising:

an elongated tubular sheath, said sheath being closed at one end and open at the other to form a mouth for reception of the pipe stem, a tubular absorbent material being transversely sized to fit within said sheath, being closed at one end and open at the other end and insertably carried within the closed end of said sheath, means carried by said liner and projecting upwardly from said liner to the mouth of said sheath for effecting retrieval of said liner, an adjustable closure strap surrounding said sheath adjacent said mouth for adjustably closing off said sheath at said mouth about the upper end of said pipe stem to frictional lock the sheath to a given variable diameter pipe stem, cigarette holder mouthpiece, etc., said sheath terminating at its mouth in a rounded lip, said absorbent material liner having an axial length which is less than that of said sheath and said means for retrieving said liner from said sheath comprising a retrieving line connected to the open end of said liner by a clip at one end thereof and connected to said sheath lip by a connector at the opposite end thereof.

* * * * *